US005967069A

United States Patent [19]

Rodriguez et al.

[11] Patent Number: 5,967,069

[45] Date of Patent: Oct. 19, 1999

[54] SEWING MACHINE CUTTING SYSTEM HAVING MICROPROCESSOR CONTROLLED CUTTING BLADE

[76] Inventors: Felipe Rodriguez, 2943 42nd St., Highland, Ind. 46322; Walther A. Moreira, 62 Medinah Cir., Glendale Heights, Ill. 60139

[21] Appl. No.: 08/925,218

[22] Filed: Sep. 8, 1997

[51] Int. Cl.[6] ..... D05B 19/12; D05B 65/02

[52] U.S. Cl. ..... 112/470.05; 112/300; 112/DIG. 3

[58] Field of Search ..... 112/300, 275, 112/67, 68, 70, 445, 448, 449, 459, 460, 461, 470.01, 470.04, 470.05, 470.14, 470.18, DIG. 3, 291, 294, 293, 296, 297

[56] References Cited

U.S. PATENT DOCUMENTS

| | | | |
|---|---|---|---|
| 3,543,737 | 12/1970 | Maschmann | 112/275 |
| 3,738,297 | 6/1973 | Sangiorgi | 112/300 X |
| 4,235,179 | 11/1980 | Ross | 112/286 |
| 4,417,531 | 11/1983 | Doyama | 112/445 |
| 4,459,925 | 7/1984 | Miyachi et al. | 112/294 |
| 4,598,657 | 7/1986 | Makabe et al. | 112/275 |
| 4,599,961 | 7/1986 | Brusasca et al. | 112/287 |
| 4,672,902 | 6/1987 | Michaels | 112/287 |
| 4,987,842 | 1/1991 | Nakamura et al. | 112/275 |
| 5,062,374 | 11/1991 | Wokeck et al. | 112/130 |
| 5,178,084 | 1/1993 | Rohr | 112/286 |
| 5,372,079 | 12/1994 | Kitai et al. | 112/291 |
| 5,603,272 | 2/1997 | Takahashi et al. | 112/300 X |

OTHER PUBLICATIONS

Brother Sewing Machine Parts Book, "High Speed Lock Stitch Pattern Tacking Machine with Treble Hook", Jan. 1983.

Brother Sewing Machine Parts Book, "High Speed Bar Tacking Machine", Dec. 1989.

*Primary Examiner*—Peter Nerbun

*Attorney, Agent, or Firm*—Marshall, O'Toole, Gerstein, Murray & Borun

[57] ABSTRACT

A cutting system for a sewing machine is disclosed. The cutting system may include a pattern cam that does not have a stopping lug or a stopping groove. The pattern cam may have two faces having substantially equal circumferences. The cutting system may comprise a pneumatically actuated, computer-controlled means for activating and positioning the moveable cutting blade which cuts both the upper needle and lower bobbin threads of a sewing machine. The pattern cam may have a stopping signal device to achieve existing timings of the sewing machine's hook and to determine the home position of the pattern's first stitch. Microprocessor-based signals may be used to count programmed stitches and pulses while reading the signals from the cam to send signals to control a manifold which opens solenoids in a series of synchronized controlled air flow forces to activate and position the moveable cutting blade which cuts both the upper needle and lower bobbin threads of sewing machine.

8 Claims, 13 Drawing Sheets

SEWING MACHINE CUTTING SYSTEM HAVING MICROPROCESSOR CONTROLLED CUTTING BLADE

BACKGROUND OF THE INVENTION

This invention relates to sewing machines and to cutting systems for same. More particularly, this invention relates to a pneumatically actuated, computer-controlled cutting system for a cam pattern sewing machine.

Some conventional mechanically driven sewing machines use continuously run motors which drive a belt system to turn clutches which move a shaft. A cutting cam moves an arm shaft, a spring and a tension release in synchronization with the hook and needle. The cutting cam, arm shaft, and spring thus position the movable cutting blade to first and second positions for trimming both the upper needle thread and lower bobbin thread.

In mechanically driven pattern tacker systems, a pattern cam determines the specific timing and movement of a cutting blade. A pattern cam 200 of the kind used in most conventional mechanically driven machines is shown in FIGS. 1*a* and 1*b*. The conventional pattern cam 200 has a first face 205 (FIG. 1*a*) and a second face 210 (FIG. 1*b*), each face defining a stitching groove 215 for determining a sewing pattern. The first face 205 of the conventional pattern cam is substantially circular, and the second face 210 defines a stopping lug 218 and a stopping groove 223. The stopping lug 218 engages a lever (not shown) or some other member to engage a cutting cam. The stopping groove 223, which is necessary in some conventional pattern tackers to guide a roller, is disadvantageous because the stopping groove 223 results in a thin, weak stitching groove all 225 where the stitching groove 215 of the second face 210 is close to he stopping groove 223. Thin portions of the stitching groove wall 225 re designated at 227 in FIG. 1*b*.

Some conventional electronically controlled pattern tacking sewing machines use a stepping motor to move a workpiece plate in "X" and "Y" axis directions. When cutting is to be performed, the motor is slowed through a series of electronic signals to insert a roller, which has a standard rod connected to linkage, into a slot within the cutting cam. Once the roller is in the slot, the movable cutting blade is moved to trim both the upper needle and lower bobbin threads of the sewn work piece.

Operation of the cutting cam in either a conventional mechanical pattern tacking sewing machine or a conventional electronically controlled pattern tacking sewing machine requires many parts including a roller to follow the cutting cam, levers, and, in conventional mechanically controlled sewing machines, clutches. Such parts can be expensive to assemble and properly maintain. Further, a spring returns the cutting blade to a home position. Such spring mechanisms are a relatively weak and unreliable means for returning the cutting blade to the home position. If the blade does not fully return because of a weak spring, the needle may hit the blade, possibly breaking the needle, the blade, and the needle plate.

In some cutting systems for conventional mechanical sewing machines, if the sewing machine is stopped mid-cycle (e.g., for an emergency) then the cutting blade might still be driven to cut the thread. If the needle happened to be down when the sewing machine was stopped, the cutting blade would hit the needle, possibly breaking the needle, the blade, and the needle plate. Also, the clutches and other cutting assembly parts might require significant readjustment prior to use following a collision of the cutting blade and the needle.

In some cutting systems for conventional electronic and conventional mechanical sewing machines, a tension release mechanism is connected to the cutting cam. Being connected to the cutting cam results in the tension release lever being activated at the same point in every cycle. Further, changing the tension release mechanism timing requires adjustments of many parts.

In some conventional mechanically or electronically controlled sewing machines, the cutting blade remains in the second or cutting position until a few stitches of a subsequent sewing cycle have been completed. Following those stitches, the cutting blade is retracted. This is disadvantageous because it requires more thread from the bobbin.

In some conventional pattern tackers, in order to change the speed of the motor, the motor had to be changed or the puller and belt had to be changed. Such changes are inefficient.

SUMMARY OF THE INVENTION

The aforementioned disadvantages of the prior art devices are overcome using a pattern cam or a cutting mechanism in accordance with the present invention. One aspect of the invention is a pattern cam for a pattern tacker. The pattern cam may comprise first and second faces, wherein the first and second faces do not define a stopping lug. Additionally or alternatively, the pattern cam may comprise signalling means, such as a magnetic member, attached to the pattern cam, for signalling a position of the cam with respect to a detector. The pattern cam may have a substantially circular first face and a substantially circular second face.

Another aspect of the invention is a cutting system for a pattern tacker having a cutting blade. The cutting system may include an air cylinder for moving the cutting blade. The cutting system may further comprise a solenoid for controlling the air cylinder. The cutting system may comprise a pattern cam, signalling means attached to the pattern cam, detector means for detecting a signal from the signalling means to determine the position of the pattern cam, and a computer coupled to the detector means and to the air cylinder for controlling the air cylinder to move the cutting blade to the first position. The pattern cam may comprise a substantially circular first face and a substantially circular second face. The signalling means may be a magnetic member.

Pattern tacking sewing machines in accordance with the present invention have higher effective and, therefore, more productive cutting speeds.

In some embodiments of the present invention, an electronic motor drive system is used in conjunction with an encoder to count programmed stitches and synchronized pulses in order to activate and position the movable blade to a first position, hook the needle thread, release the thread tension, activate and position the blade in a second position to cut the thread, and stop the machine in the home position.

One electronic signal in some embodiments of the present invention replaces approximately six mechanisms commonly used to accomplish the cutting functions.

Other features and advantages are inherent in the apparatus claimed and disclosed or will become apparent to those skilled in the art from the following detailed description in conjunction with the accompanying drawings.

DETAILED DESCRIPTION OF THE INVENTION

Figure 2:
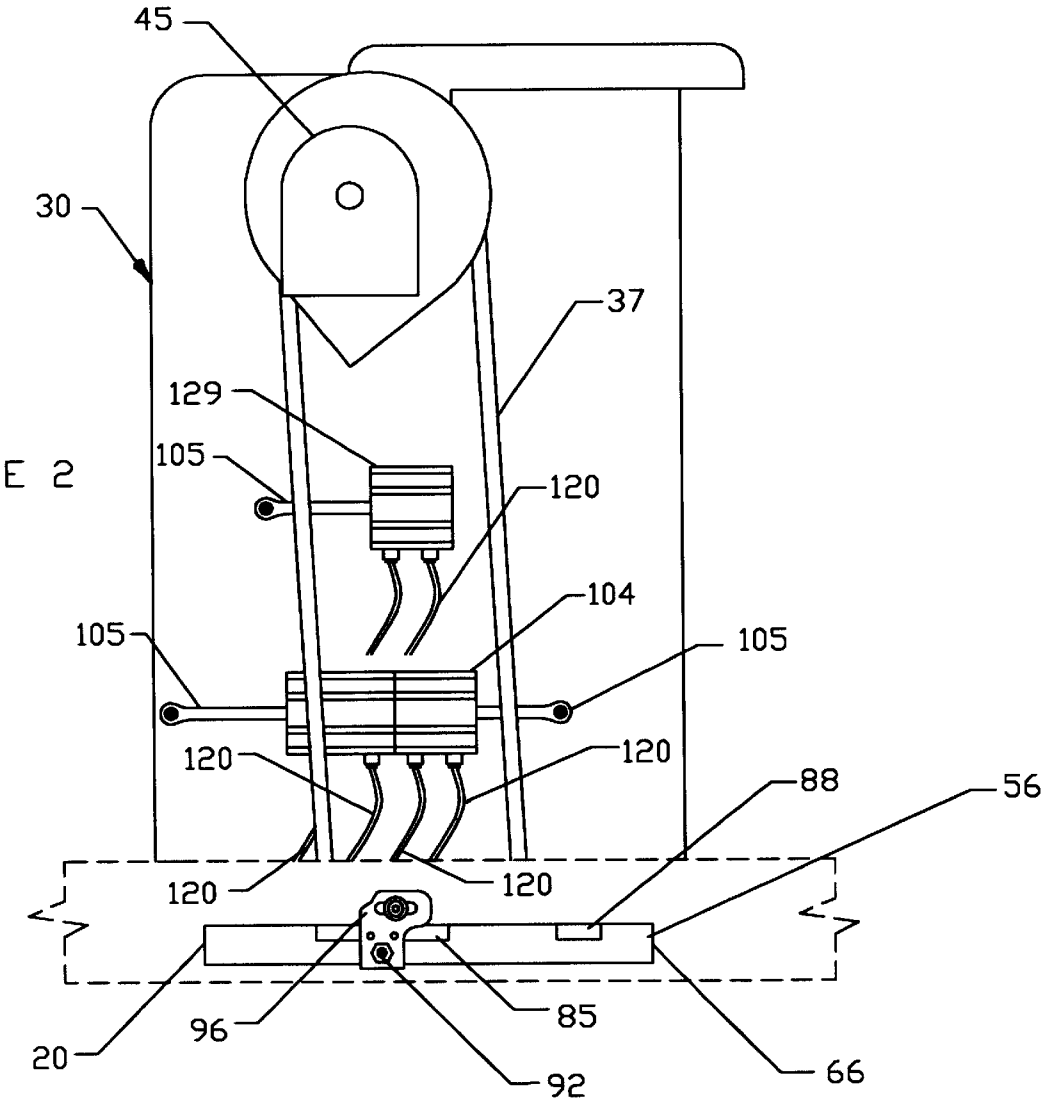
FIG. 2 is a side elevational view, with portions broken away, of a back of a pattern tacking sewing machine in accordance with the present invention.
Figure 3:
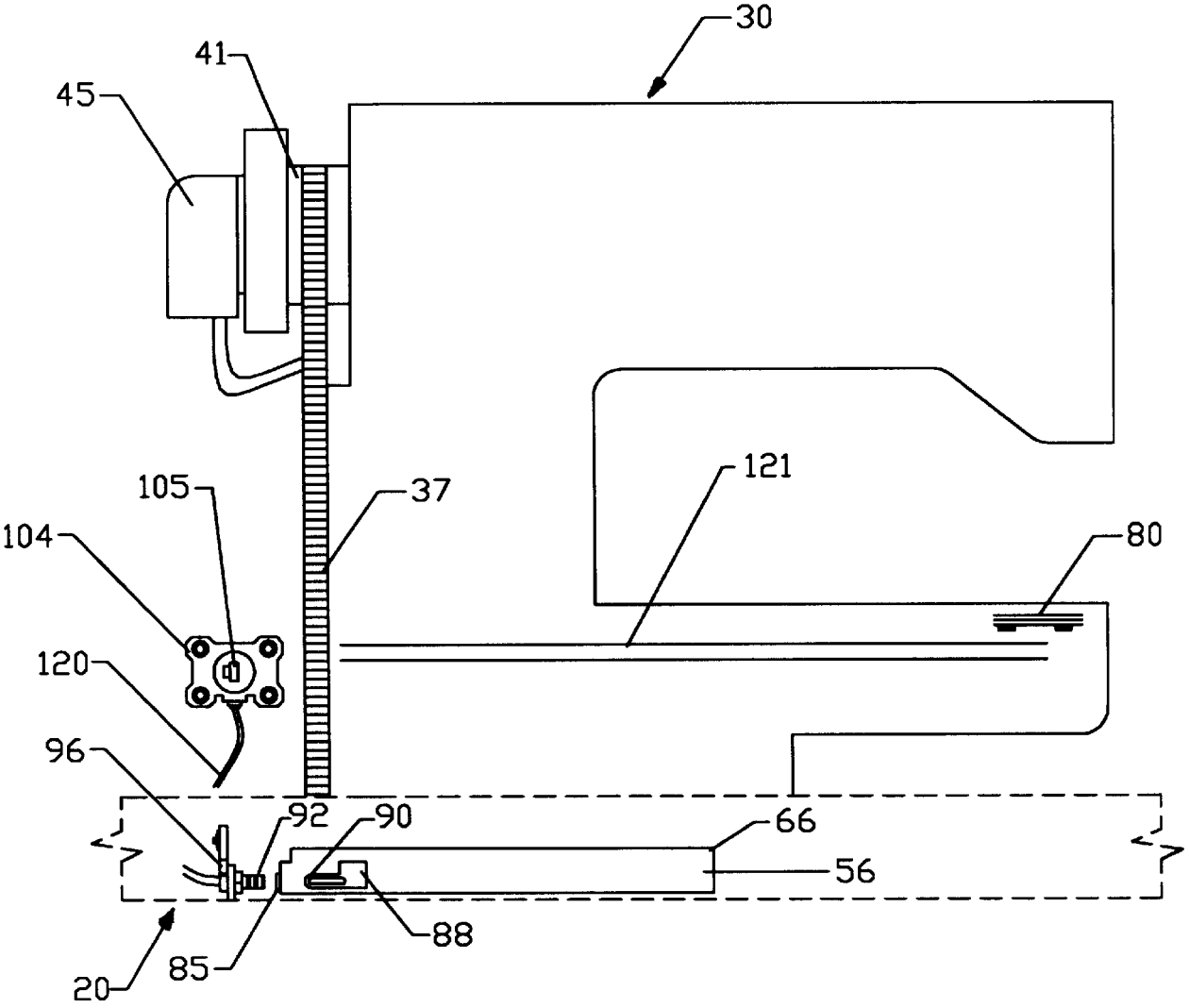
FIG. 3 is a side elevational view, with portions broken away, of a side of the pattern tacking sewing machine of FIG. 2.

A back view (FIG. 2) and side view (FIG. 3) show a cutting system 20 in accordance with the present invention installed on a typical pattern tacking sewing machine 30 such as a Brother 430, a Brother 484, a Singer 269, or a Singer 68 Class. The pattern tacking sewing machine 30 may be used to sew seatbelts or other items.

Figure 4A:
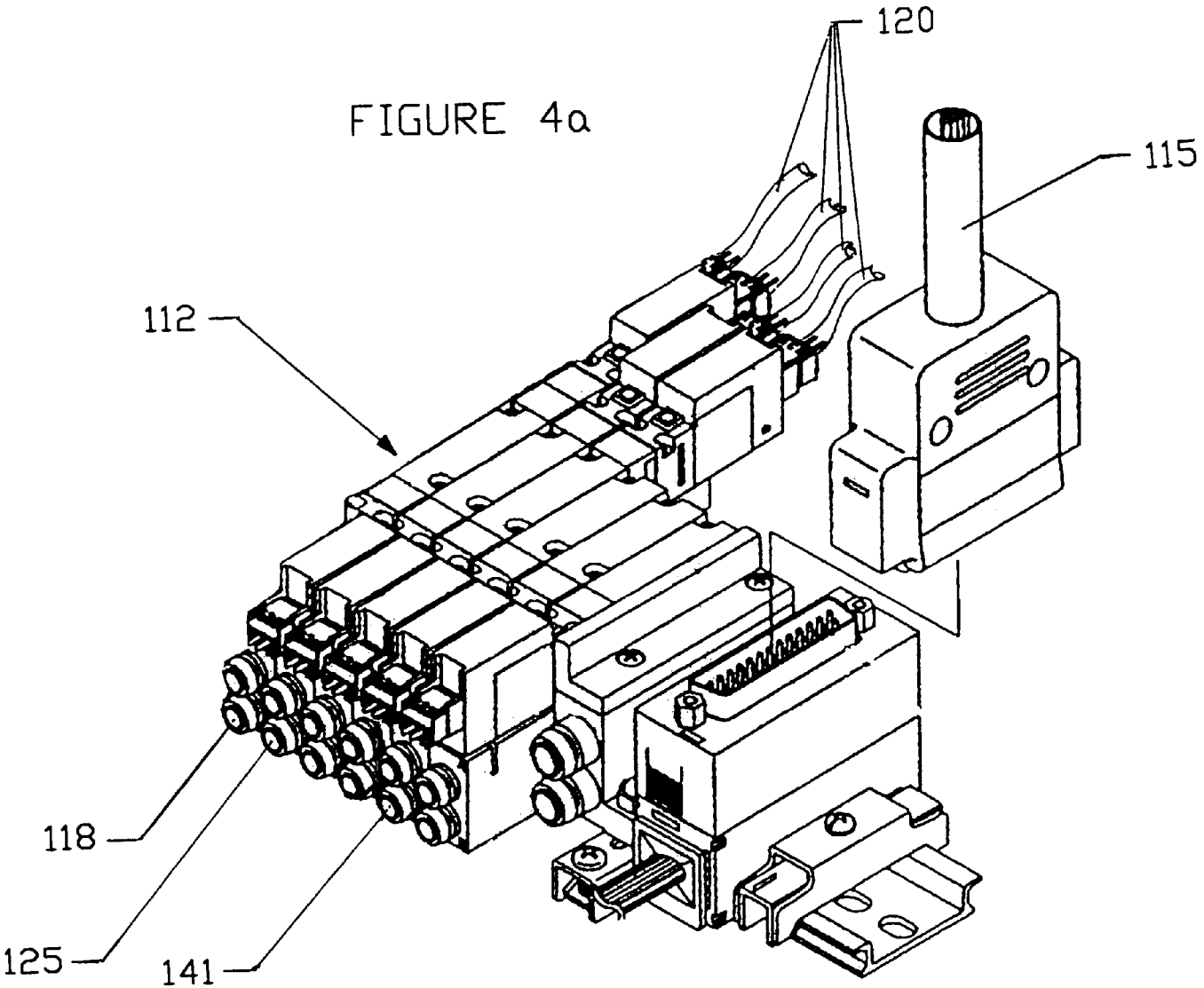
FIG. 4*a* is a perspective of a manifold.
Figure 4B:
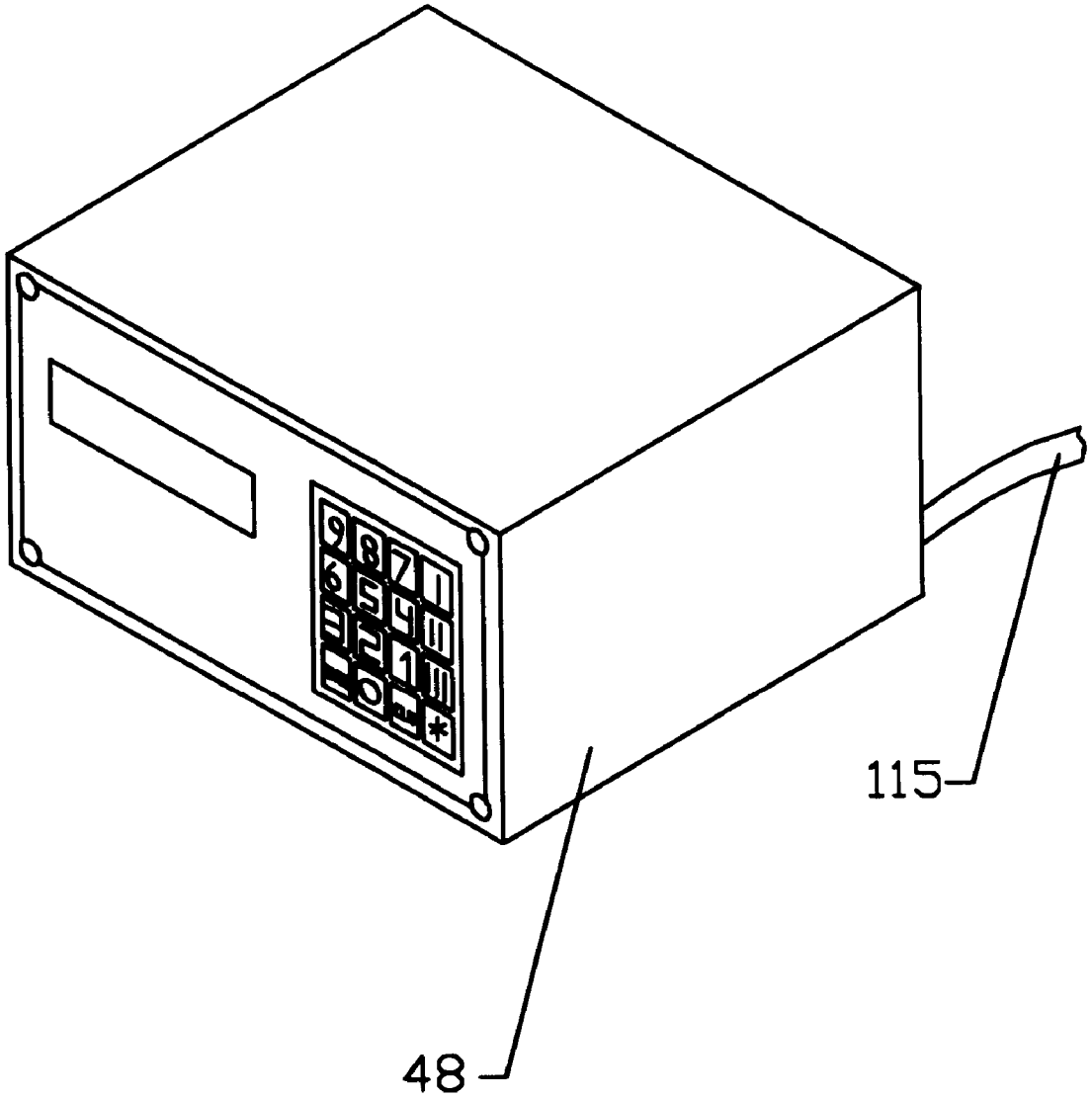
FIG. 4*b* is a perspective of a microprocessor.

The system 20 is powered on with a motor (not shown) that can be electronically controlled by a pedal, a band switch, or any other suitable controlling device (not shown) coupled to a microprocessor 48 or computer (FIG. 4*b*). The motor rotates a driving belt 37 to rotate a wheel 41. The wheel 41 sends signals or pulses to a synchronizer or encoder 45. The encoder 45 sends signals to the microprocessor 48 for analysis and processing. The microprocessor 48 sends signals to the motor, such as signals to decrease or increase the speed of the motor. The wheel 41 produces 360 pulses per one top-to-bottom or one bottom-to-top cycle of the sewing machine needle (not shown), the 360 pulses also corresponding to 360 degree rotation of the wheel 41.

Figure 9B:
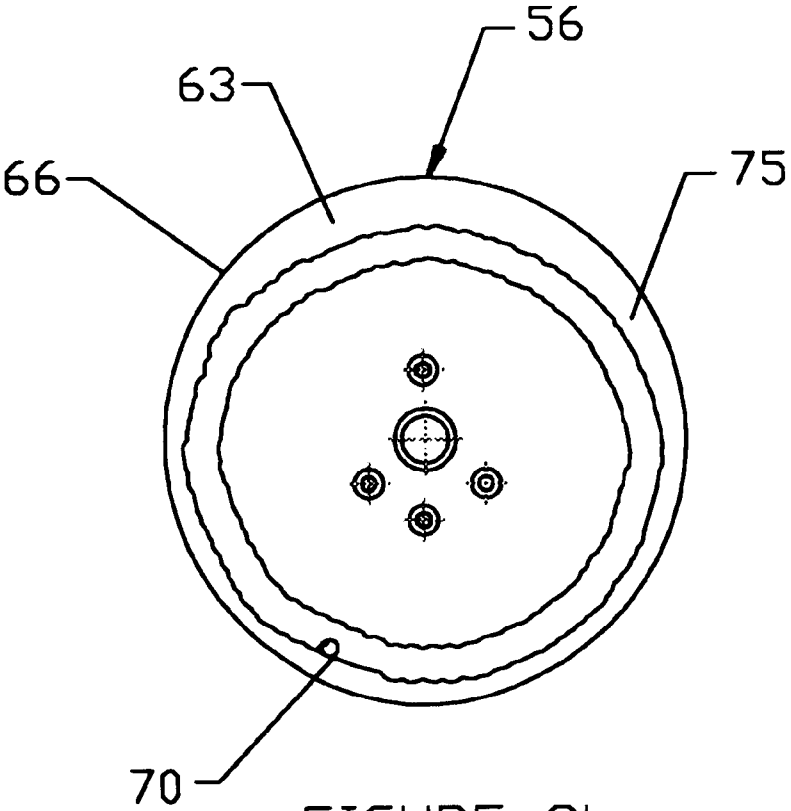
FIGS. 9*a* and *b* are plan views of opposing faces of a pattern cam in accordance with the present invention.
Figure 9A:
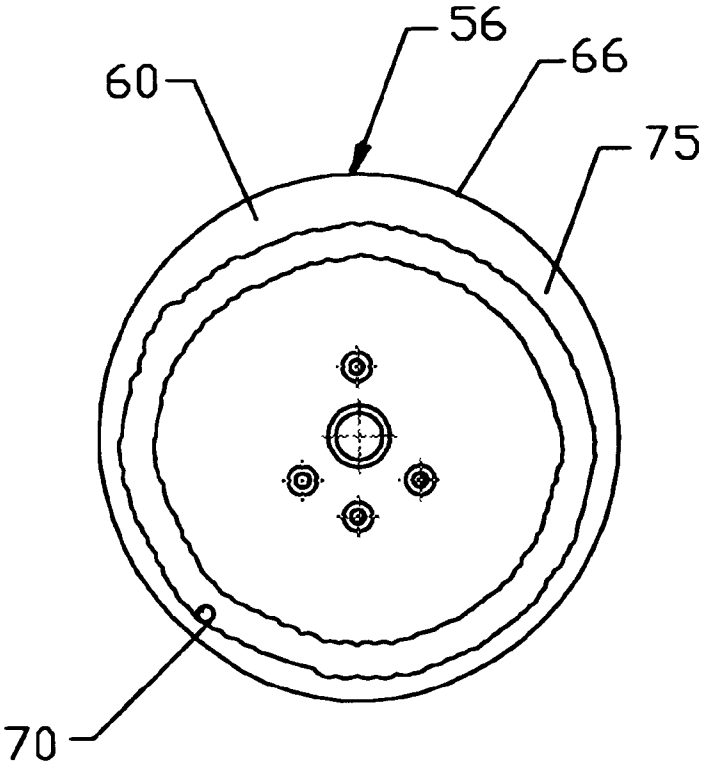

A pattern cam 56 is shown in FIGS. 9*a* and 9*b* and has a first face 60 having a first circumference, a second face 63 having a second circumference, and a circumferential surface 66. The first and second faces 60, 63 of the pattern cam 56 may be substantially circular, as shown. The first circumference and the second circumference may be substantially equal to one another, as shown. The first and second faces 60, 63 of the pattern cam 56 do not define a stopping lug. The first face 60 and the second face 63 of the pattern cam 56 each define a stitching groove 70 for determining the pattern to be sewn.

Figure 1B:
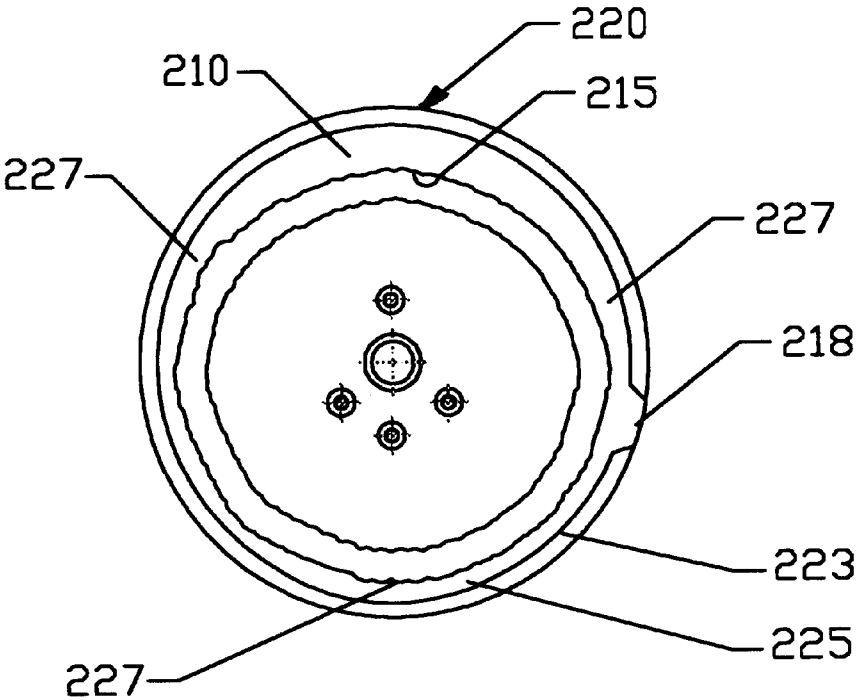
FIGURE 1b PRIOR ART
FIGS. 1*a* and 1*b* are plan views of opposing faces of a prior art pattern cam.
Figure 1A:
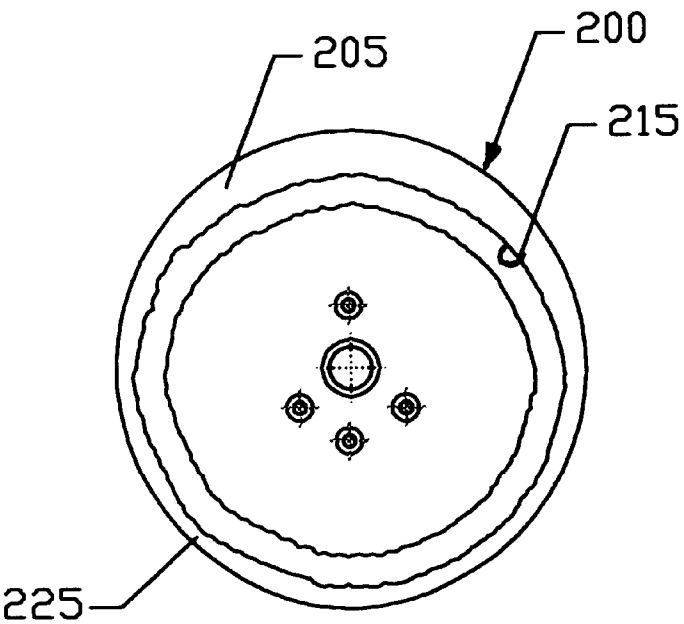
FIGURE 1a PRIOR ART

The pattern cam 56 may have the same diameter as the maximum diameter of a conventional pattern cam. The pattern cam 56 is stronger than a conventional pattern cam made of the same material. The strength results from the lack of a stopping groove 223 (FIG. 1*b*), so that a stitching wall 75 of the pattern cam 56 is relatively thick compared to the stitching wall of conventional pattern cams (see 227 in FIG. 1*b*). The pattern cam 56 may be made of plastic, wood, steel, fiberglass, or any other suitable material.

As described more fully below, the cam 56 provides for preset timings of the home position to signal the microprocessor 48 which, through the counting of synchronized pulses, activates pneumatically controlled cylinders to position a movable cutting blade 80 to first and second positions for trimming of both the upper needle and lower bobbin, threads.

Figure 11B:
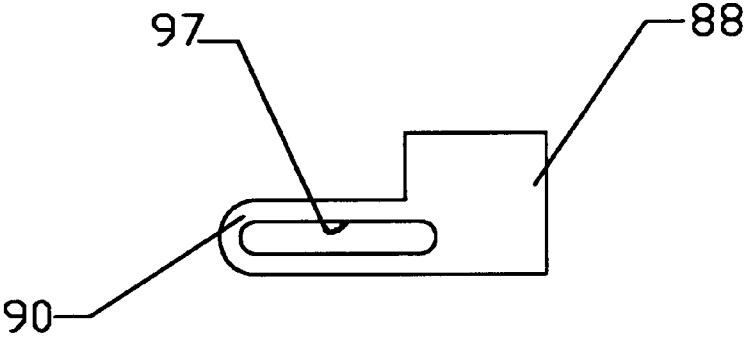
FIG. 11*b* is an enlarged, side elevational view of another bracket and stop indicator in accordance with the present invention.
Figure 11A:
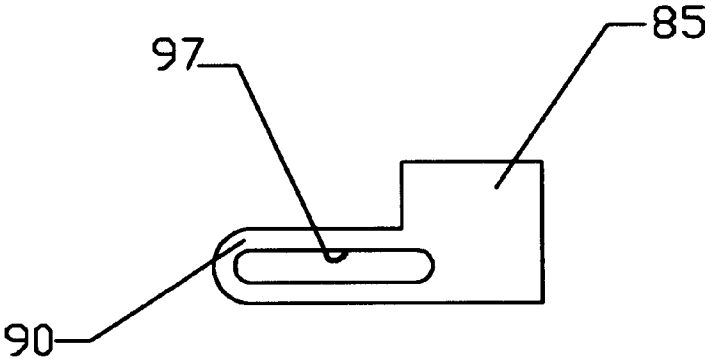
FIG. 11*a* is an enlarged, side elevational view of a bracket and a stop indicator in accordance with the present invention.

Referring again to FIGS. 2 and 3, the cutting system 20 includes a first stop indicator 85 or first signalling device mounted on the pattern cam 56 and a second stop indicator 88 or second signalling device mounted on the pattern cam 56. Each stop indicator may be mounted to the cam 56 by a bracket 90. The bracket 90 may be integral with the indicators 85, 88, as shown in FIGS. 11*a* and 11*b*.

The cutting system 20 also includes a cam detector 92 or proximity switch mounted to a housing of the sewing machine 30, adjacent to the cam 56, by a detector bracket 96 or other suitable means. The detector 92 is coupled to microprocessor 48 and sends a signal to the microprocessor 48 to determine the home position of sewing cycle. As discussed further below, the cam detector 92 detects the first stop indicator 85 and then sends a signal to the microprocessor 48 to begin counting the number of remaining programmed pattern stitches, less one stitch.

To insure detection, the first and second stop indicators 85, 88 should be relatively close to the cam detector 92 when those indicators are respectively located closest to the cam detector 92. This may be accomplished by mounting the stop indicators 85, 88 on the circumferential surface 66 of the pattern cam 56 on a bracket having a desired thickness so that the detector 92 is relatively close to a respective stop indicator when the respective stop indicator is adjacent the detector 92. In this fashion, the detector 92 does not have to be placed too close to the circumferential surface 66 of the pattern cam 56 in order to detect the stop indicators 85, 88.

The bracket 90 may have a slot 97 (FIGS. 11*a*–11*b*) for adjusting placement of the stop indicators 85, 88 along the circumferential surface 66 of the pattern cam 56 using fastening means such as a screw in the slot 97. The impact of adjusting the position of the stop indicators 85, 88 is discussed below in connection with the operation of the cutting system 20.

The stop indicators 85, 88 may be composed of a magnetic material and the detector 92 may detect magnetic signals. Alternatively, the stop indicators 85, 88 could emit infrared radiation or other detectable radiation. Alternatively, the stop indicators 85, 88 may be a reflective surface, and the detector 92 may be a combination of a light source shining upon a portion of the pattern cam 56 and a light detector which detects when the stop indicators 85, 88 move into the light and thereby reflect the light from the light source into the light detector.

Alternatively, the stop indicators 85, 88 may be recesses or holes in the circumferential surface of the pattern cam.

Such holes reflect light or other signals differently than the surrounding circumferential region of the pattern cam. If light or other signals are directed at the circumferential surface 66 of the pattern cam 56, a detector would detect when the holes became close to the detector by detecting a change in the strength of the signal reflected into the detector.

Because pattern cams 56 in accordance with the present invention have a stop indicator 85 rather than a stopping lug for initiating the cutting sequence, the pattern cam 56 does not require a follower stopping lever. Followers typically press against a pattern cam 56 with significant spring-induced pressure. Because the pattern cams of the present invention do not require a follower, such pattern cams undergo much less wear during operation than conventional pattern cams.

First and second double-acting cylinders 101, 104 are used to drive the cutting blade 80. Both of cylinders 101, 104 have a ball joint rod 105. A clevis or other member extending from the cylinders 101, 104 may also be suitable. No springs are required to drive the cutting blade 80. The first cylinder 101 may have a 5 mm stroke and a ⅞ inch (metric) bore. The second cylinder 104 may have a 7 mm stroke and a ⅞ inch (metric) bore. The cylinders 101, 104 may be repairable.

An operator can select different motor speeds or motor rpm for different portions of the sewing cycle by having the microprocessor 48 signal the encoder 45 to control the motor speed. Thus, for example, the motor may be at a slow speed at the start of a sewing cycle, a high speed for most of the remainder of the cycle, and then a slow speed to finish the cycle.

To operate a sewing machine having a cutting system in accordance with the present invention, an operator activates a treadle or other control to start the motor. The sewing cycle begins with the pattern cam 56 being at the home position. The pattern cam 56 rotates, causing stitches to be placed in accordance with the stitching pattern on the pattern cam 56. The detector 92 and the microprocessor 48 are ready to receive a signal from the first stop indicator 85 of the pattern cam 56.

When the stopping signal, which is a 180° signal, from the first stopping indicator 85 is detected by the detector 92, the microprocessor 48 sends a signal to the motor which causes the motor to slow down (e.g., from about 2000 rpm to about 200 rpm). Such slowing is accomplished without clutches, as would be required by conventional mechanically controlled sewing machines. The decreased speed facilitates the cutting of the thread.

Also when the stopping signal from the first stopping indicator 85 is detected, the microprocessor 48 starts counting to a predetermined number of encoder pulses which equals 720 times the predetermined number of stitches. The predetermined number of stitches equals the number of stitches necessary to finish the cycle (i.e., to return the pattern cam to the home position) when the first stopping signal has been detected minus one stitch. Generally, the predetermined number of stitches may be a number from 5 to 8, which corresponds with the pattern cam 56 being from 6 to 9 stitches away from the home position when the first stopping signal has been detected. However, other numbers of stitches are suitable for the predetermined number. Prior to the cycle, the first stop indicator 85 was positioned on the pattern cam 56 at a location that was calculated so that the cycle would be completed when the pattern cam 56 reaches the home position.

The stitches following detection of the first stopping signal and preceding the last stitch are counted electronically through the encoder 45. This electronic system permits self-timing and reduces the number of mechanical adjustments required to alter the timing.

When the number of synchronized pulses matches the programmed or predetermined number of pulses (i.e., the predetermined number of stitches times 720), the sewing machine 30 is ready to begin the final stitch and the microprocessor 48 begins to count a predetermined time (e.g., 230 milliseconds). This predetermined time allows the last stitch to begin and, at the end of the predetermined time, a rotary hook (not shown) is at the 6:00 position relative to the needle, the 6:00 position being the needle's lowest position. The relationship of the rotary hook to the needle, for purposes of cutting thread, is the same for sewing machines 30 in accordance with the present invention as that relationship is for conventional sewing machines. From when the needle is at the throaplate of the sewing machine 30 to when the needle is at the 6:00 position, 180 pulses occur.

Figure 8:
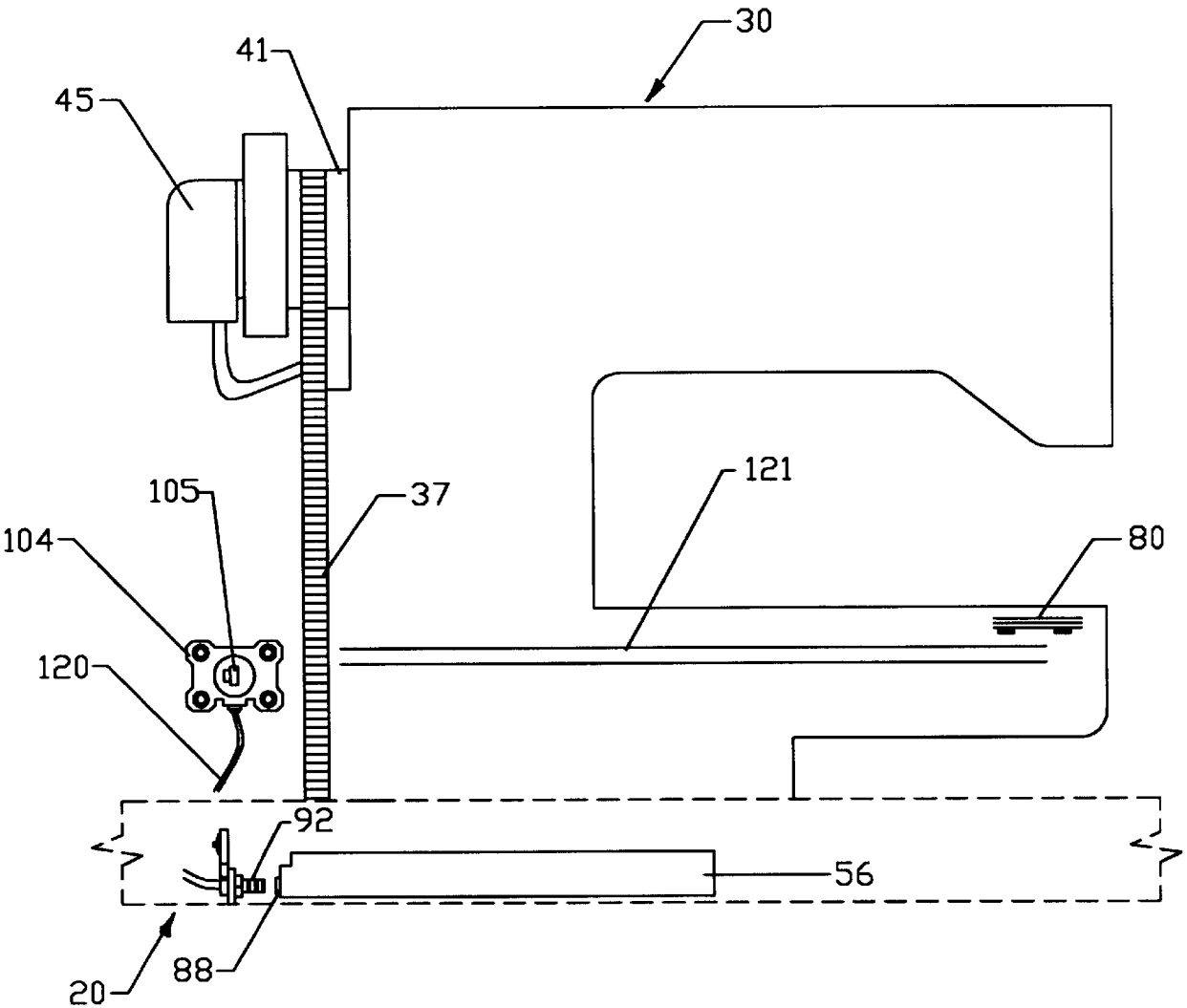
FIG. 8 is a side elevational view, with portions broken away, of a sewing machine in accordance with the present invention showing a cylinder signalling to a blade rod to signal movement of cutting blades to the first and second positions.

After the predetermined time following the start of the final stitch, the microprocessor 48 sends a signal by way of a computer cable 115 which opens a solenoid 118 which activates a manifold 112 (FIG. 4*a*) to send air via a hose 120 to the first air cylinder 101 which, with a controlled air force, moves a rod 121 (FIG. 8) which positions the movable cutting blade 80 to the first position. When the first cylinder 101 was activated and the cutting blade 80 moved to the first position, the cutting blade 80 became engaged in a loop of thread. In other words, hooking of the thread occurred when the cutting blade 80 moved to the first position. A suitable outer diameter for the hose 120 is 5/32 inches.

Following hooking, the microprocessor 48 carries out a predetermined delay (e.g., 250 milliseconds) to maintain tension after hooking for a brief amount of time so that the cutting blade 80 does not unhook. During the delay, the needle will move to a fully raised or top dead center up position and complete the final stitch of the sewing pattern. The sewing pattern or sewing cycle has now been completed and the pattern cam 56 is now back in the home position.

Figure 6:
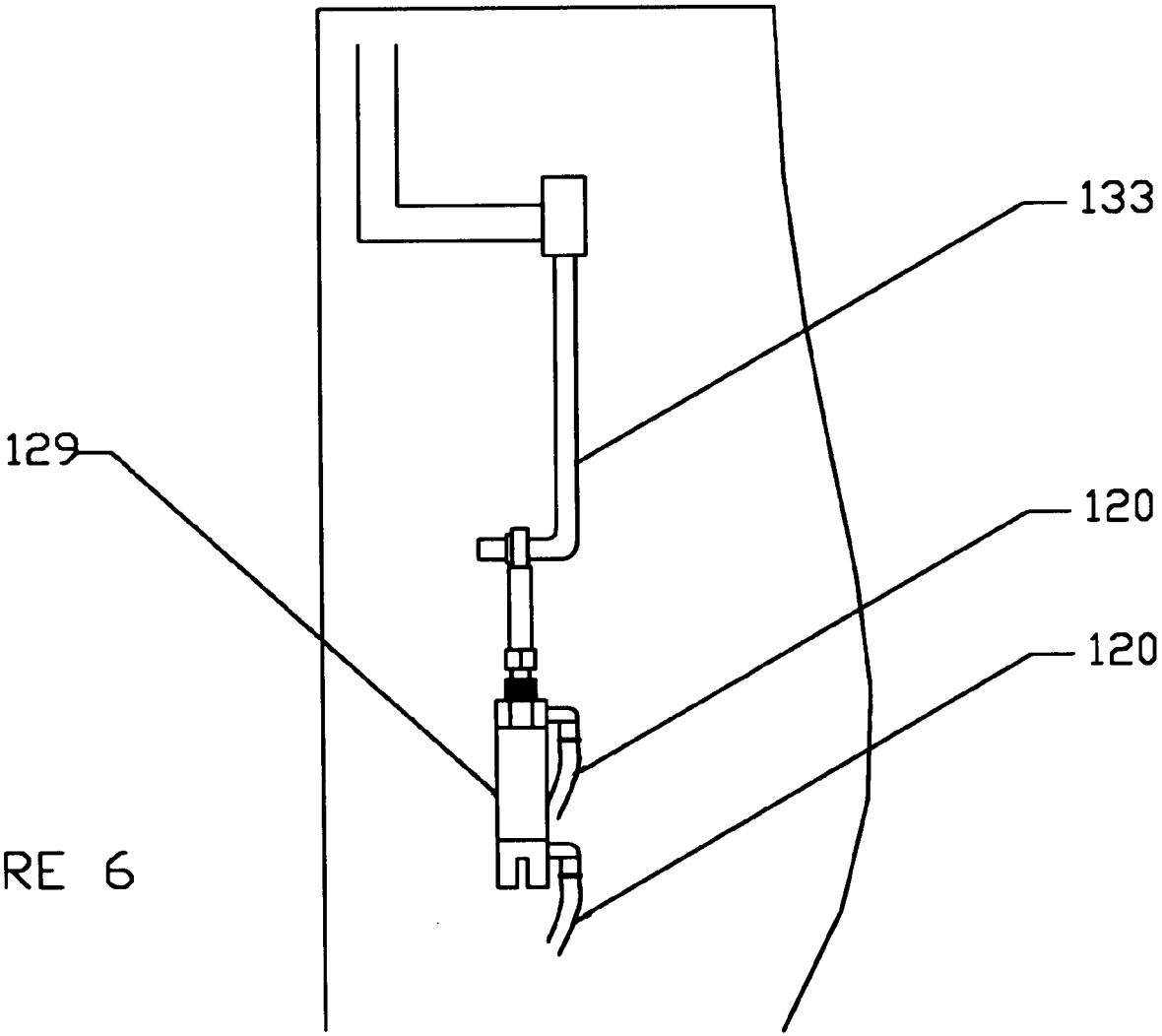
FIG. 6 is a plan view of a tension release pneumatic cylinder for a sewing machine in accordance with the present invention.
Figure 7B:
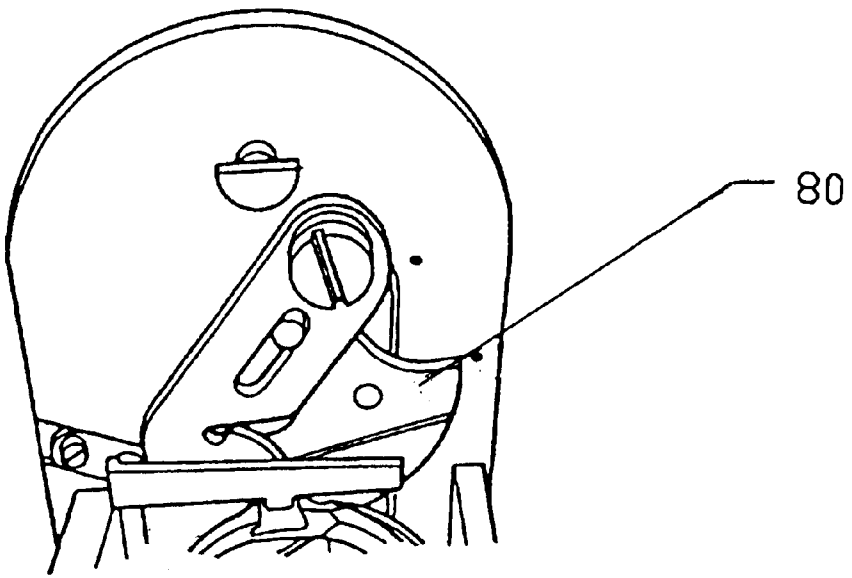
FIGS. 7*a* and 7*b* are perspective views of a first cutting blade position and a second cutting blade position, respectively.
Figure 7A:
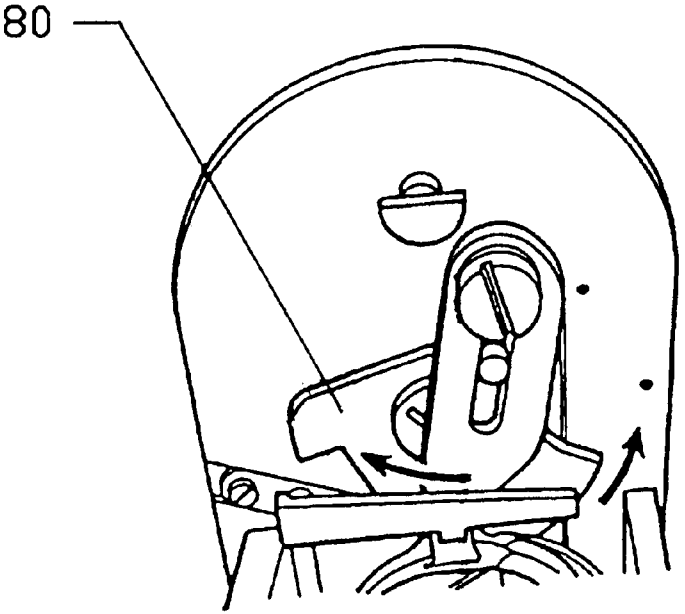
Figures 12A, 12B:
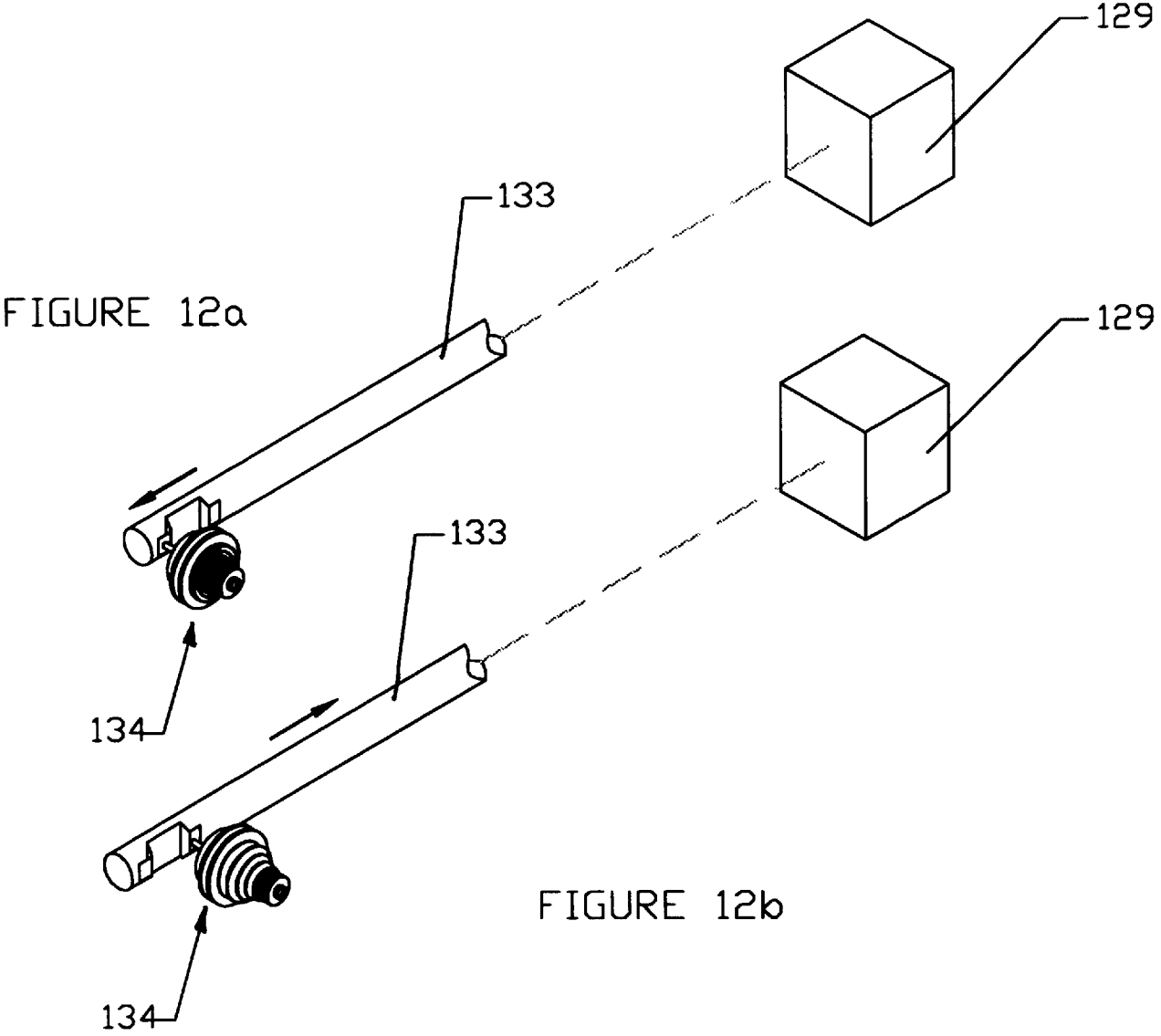
FIG. 12*a* is an enlarged perspective of a tension release in a closed position.
FIG. 12*b* is an enlarged perspective of the tension release of FIG. 12*a* in an open position.

Following the delay that followed hooking, the microprocessor 48 sends a signal to open a solenoid 125 which activates the manifold 112 which sends an air force via a hose 120 to a pneumatic cylinder 129 (FIG. 6) which moves a tension release rod 133 to open a tension release 134 (FIG. 12*b*) to release upper thread which the needle, with the aid of the rotary hook, pulls into a loop position ready for the movable cutting blade 80 (FIG. 7) to be activated. The tension release 134 is shown in a closed position in FIG. 12*a* and is shown in an open position in FIG. 12*b*. The rod 133 moves to the open and closed positions under the influence of the cylinder 129. A suitable outer diameter of the hose 120 is 5/32 inches.

Figure 10:
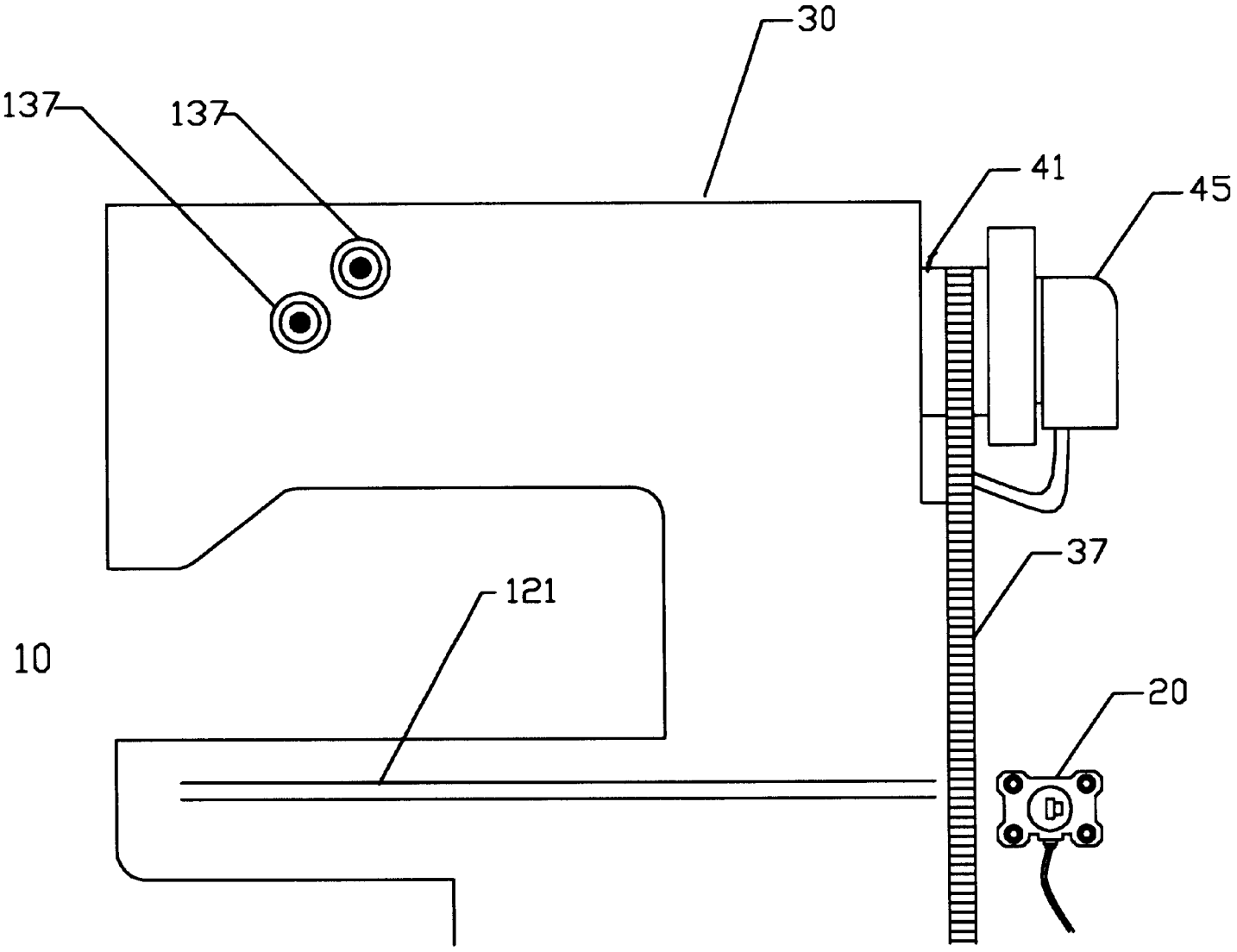
FIG. 10 is a side elevational view of pattern tacking machine having thread tension release controls.

The tension release 134 stays open until the start of the next cycle. By opening the tension release 134 prior to cutting, enough thread will remain on the needle after cutting so that the next sewing pattern may be initiated without the needle becoming unthreaded. A tension release assembly 137 is shown in FIG. 10.

At the same time that the tension release cylinder 129 is activated, the second air cylinder 104 is activated by the microprocessor 48. Activation of the second air cylinder 104 is accomplished by sending a second signal from the microprocessor 48 to open a solenoid 141 which activates the manifold 112, sending forced air via the hose 120 to activate the second air cylinder 104. A suitable outer diameter of the hose 120 is 5/32 inches. When the second air cylinder 104 is activated, the blade connecting rod 121 is moved to move the movable cutting blade 80 into the second position (FIG. 7*b*), thereby cutting the upper needle and lower bobbin threads.

Figure 5:
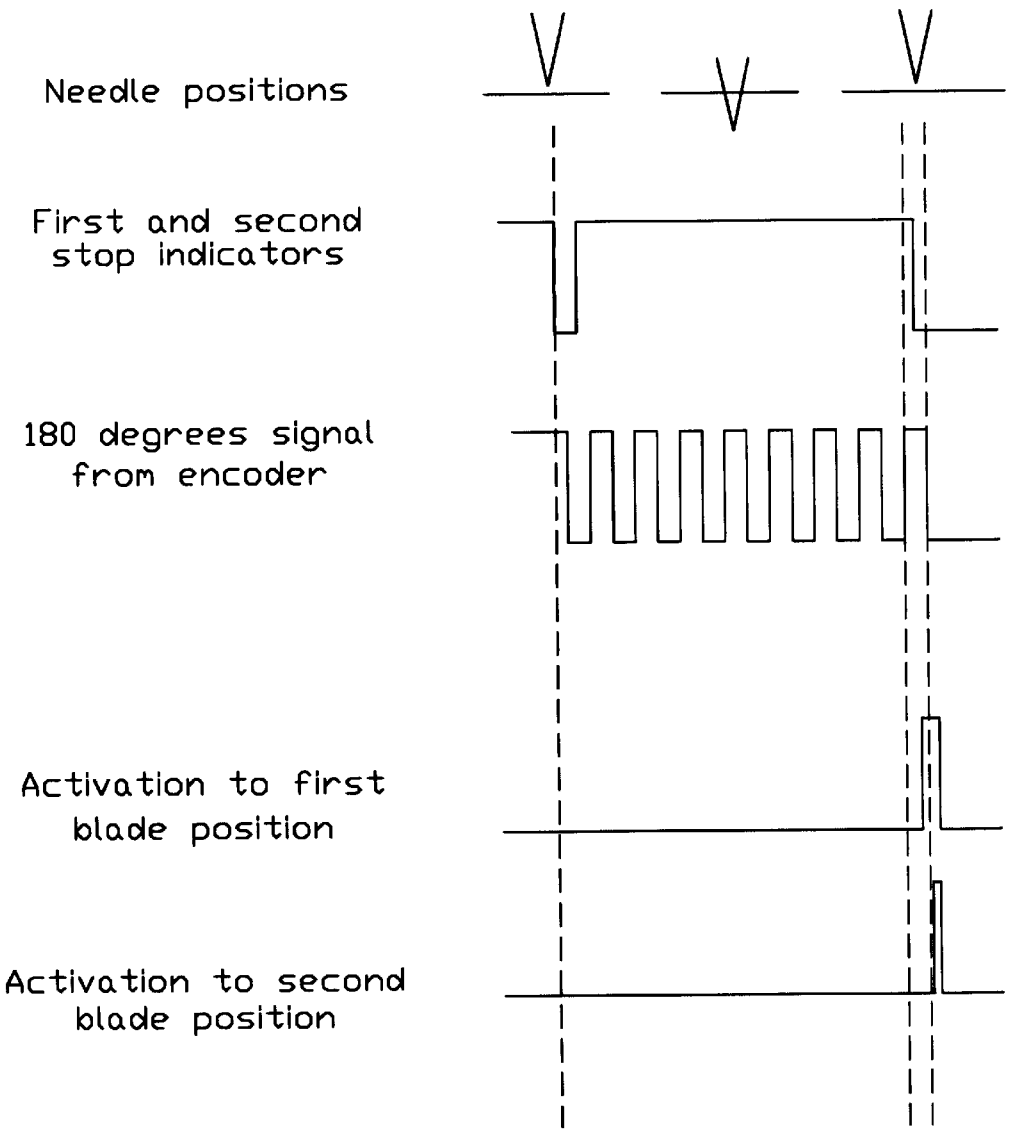
FIG. 5 is a schematic of encoder signals and corresponding needle positions.

FIG. 5 shows encoder signals and corresponding needle positions for the final stitch of a cycle. The leftmost side of FIG. 5 corresponds with the detector 92 detecting a signal from the first stop indicator 85.

Because air cylinders provide the force for the cutting of the threads, the cut is more powerful and reliable than devices relying on a spring to move the cutting blade. This allows cutting systems in accordance with the present invention to cut the largest, thickest threads. In some embodiments of the present invention, the cutting force may be adjusted by the microprocessor 48 to be at a proper speed and timing for producing consistency in shorter thread tails on the workpiece due to less thread being brought into the stitch.

A delay, such as a 175 millisecond delay, is carried out after the cut has been completed and prior to the retreating of the cutting blade 80. Following that delay, the microprocessor 48 sends a signal to the solenoids 118, 125, which activate manifold 112 which activates the first and second air cylinders 101, 104. The cylinders 101, 104 are double-acting and are reset at the same time, returning the cutting blade 80 to the home position. Because of the double-acting cylinders 101, 104, the cutting blade 80 may be returned to the home position at the same speed as it was activated.

Embodiments having first and second air cylinders 101, 104 do not require a cutting cam, a cam roller, clutches, a power cam cutter, or a spring in the cutting assembly to cut the thread. Omission of those mechanical parts, which have a tendency to wear and break, increases the reliability of the cutting assembly.

Although the structures described above for moving the cutting blade 80 and for opening and closing the tension release 134 have included air cylinders, other devices may be suitable. For example, solenoids could be used to move the cutting blade 80 or open and close the tension release 134 without the use of air cylinders. Alternatively, hydraulic devices may be suitable for moving the cutting blade 80 or opening and closing the tension release 134.

After the cut has been completed, while the tension release 134 is still open, while the needle is in an up position, and after the cutting blade 80 has returned from the second position to the cutting blade home position, the second stopping indicator 88 is detected by the detector 92. At that point, the second stopping indicator 88 should be at the true home position. In effect, the second stopping indicator 88 on the pattern cam 56 verifies that the pattern cam 56 has reached the true home position at the end of the sewing cycle.

A presser foot (not shown) unclamps and raises up. The first workpiece may now be moved or removed. A second workpiece may be inserted before clamping the left and right clamps (i.e., the presser foot). Upon clamping the presser foot down against the workpiece, the operation cycle may begin again by operating the motor controller. When the motor starts, the tension release 134 closes and the stitching begins.

Because the air cylinders 101, 104, 129 are driven by electronic controls, those air cylinders can fire at any predetermined time or at many different speeds. The microprocessor can be programmed to determine when and how powerfully the cylinders fire. Flexibility results from the firing of the cylinders 101, 104, 129 being independent of the pattern cam 56. To alter firing, an operator can move the relative positions of the first and second stop indicators 185, 188 and program the microprocessor to cause a desired delay.

Thus, the cutting system increases cutting speed by a factor of 3 to 4 over a typical mechanical system (which uses a cutting cam, springs, a power cam cutter, and cam levers).

Further, by utilizing three pneumatic cylinders (cylinders 101, 104 to position the blade 80; cylinder 129 for tension release) in a synchronized series based on signals from the pattern cam 56 to provide the correct strokes, preset timings are possible without requiring complex mechanical adjustments.

The solenoids 118, 125, and 141 are double-acting solenoids. 24 d.c. solenoids are suitable.

In some embodiments, an operator can also monitor thread breakage on the needle thread. Additionally or alternatively, the sewing machine 30 may include a production counter (not shown) to count the total number of articles sewn per day.

A bobbin counter (not shown) can be preset to warn an operator that the bobbin needs replacement. The bobbin counter is preset to the number of complete sewing cycles that the operate believes a single bobbin can perform. After two warnings from the bobbin counter, the sewing machine stops and the operator must reset the machine or replace the bobbin in order to continue. The bobbin counter only counts completed sewing patterns, not individual stitches.

By positioning the first and second stopping indicators 85, 88 at different distances from one another, the predetermined number of stitches can be varied. By increasing the distance between the first and second indicators 85, 88, the predetermined number of stitches increases. Similarly, by decreasing the distance between the first and second indicators 85, 88, the predetermined number of stitches decreases. This is so, because, for a given pattern cam 56, the distance between the first and second stopping indicators 85, 88 is essentially proportional to the number of stitches remaining to be completed in a sewing cycle for that pattern cam 56 following the detection of the first stopping indicator 85.

A pattern cam having a stopping lug and a stopping groove may be utilized in a cutting system in accordance with the present invention if the pattern cam has a stopping indicator similar to the stopping indicator 85 attached to it. For example, if a magnetic member is attached to a circumferential surface of a pattern cam having a stopping lug and a stopping groove, a detector will be able to detect the position of the pattern cam and control the cutting system accordingly.

The foregoing detailed description has been given for clearness of understanding only, and no unnecessary limitations should be understood therefrom, as modifications will be obvious to those skilled in the art.

We claim:

1. A cutting system for a pattern tacker having a cutting blade, the cutting system comprising:

a double-acting air cylinder for moving the cutting blade;

a pattern cam;

signalling means attached to the pattern cam;

detector means for detecting a signal from the signalling means to determine the position of the pattern cam; and a microprocessor coupled to the detector means and to the double-acting air cylinder for controlling the double-acting air cylinder to move the cutting blade.

2. The cutting system of claim 1 further comprising:

a second air cylinder for moving the blade;

the first air cylinder being for moving the blade to a first position, and the second air cylinder being for moving the blade to a second position;

the microprocessor being coupled to the detector means and to the second air cylinder for controlling the second air cylinder.

3. The cutting system of claim 2 further comprising:

a solenoid coupled to the microprocessor and the second air cylinder for controlling the second air cylinder.

4. The cutting system of claim 1 wherein:

the pattern cam does not have a stopping lug.

5. The cutting system of claim 4 wherein the signalling means is attached to a circumferential surface of the pattern cam.

6. The cutting system of claim 1 wherein:

the pattern cam comprises a substantially circular first face and a substantially circular second face.

7. The cutting system of claim 6 wherein:

the first face has a first circumference, and the second face has a second circumference; and the first circumference is substantially equal to the second circumference.

8. The cutting system of claim 1 wherein the signalling means produces a signal selected from the group consisting of electronic signals, light signals, and magnetic signals.

* * * * *